United States Patent [19]

Kishino et al.

[11] 4,232,251

[45] Nov. 4, 1980

[54] MULTI-DIGIT LUMINESCENT DISPLAY TUBE

[75] Inventors: Takao Kishino; Gentaro Tanaka, both of Mobara, Japan

[73] Assignee: Futaba Denshi Kogyo K.K., Chiba, Japan

[21] Appl. No.: 24,261

[22] Filed: Mar. 27, 1979

Related U.S. Application Data

[63] Continuation-in-part of Ser. No. 831,083, Sep. 6, 1977, abandoned.

[30] Foreign Application Priority Data

Sep. 3, 1976 [JP] Japan ..... 51-117701[U]

[51] Int. Cl.[2] ..... H01J 63/06; H05B 41/14

[52] U.S. Cl. ..... 315/167; 313/190; 313/497

[58] Field of Search ..... 313/496, 497, 495, 190, 313/411; 315/169.2, 169.3, 169.1, 167

[56] References Cited

U.S. PATENT DOCUMENTS

| | | | |
|---|---|---|---|
| 2,270,159 | 1/1942 | Bartelink | 313/495 |
| 2,686,273 | 8/1954 | Hough et al. | 313/190 |
| 3,418,509 | 12/1968 | Frouws et al. | 313/190 X |
| 3,703,657 | 11/1972 | Shesser | 313/190 X |
| 3,868,535 | 2/1975 | Kupsky | 313/190 X |
| 4,156,239 | 5/1979 | Hirano et al. | 313/496 X |

*Primary Examiner*—Palmer C. Demeo

*Attorney, Agent, or Firm*—Oblon, Fisher, Spivak, McClelland & Maier

[57] ABSTRACT

A multi-digit luminescent display tube having a plurality of pattern display sections arranged in the form of a matrix within a vacuum envelope is disclosed. The pattern display sections include a plurality of anodes, control grids, cathode filaments and shielding members. The shielding members are arranged midway between rows or columns of the pattern display sections in a direction along which the cathode filaments are stretched, whereby to shield each of the rows or columns of the pattern display sections from thermions emitted from the cathode filaments which are stretched in different rows or columns of the pattern display sections.

5 Claims, 8 Drawing Figures

MULTI-DIGIT LUMINESCENT DISPLAY TUBE

This is a continuation-in-part application of Ser. No. 831,083 filed Sept. 6, 1977, now abandoned.

BACKGROUND OF THE INVENTION

The present invention relates to a multi-digit luminescent display tube having a plurality of pattern display sections arranged in the form of a matrix.

With the recent progress and diversification of all kinds of electronic devices, there has been an increasing need of display devices capable of displaying more kinds and greater amounts of information.

For instance, in a display device which employs a luminescent display tube characterized by its clear luminescent color, low-voltage operation, low power consumption, etc., the luminescent display tube is made to be of the so-called multi-digit type having a plurality of pattern display sections arranged in one direction so that the amount of information that can be displayed may be increased. In this case, however, if the pattern display sections increase in number, the area they require will be lengthened in the direction of their arrangement and therefore the display tube will be increased in size and as a result will become too large to be incorporated in an electronic device.

As another example, there is a luminescent display device which is provided with a plurality of multi-digit luminescent display tubes disposed parallel with each other in the direction vertical to the arrangement direction of the pattern display sections so as to increase the amount of information that can be displayed. In the case of such a luminescent display device, however, complicated connecting operations are required for the multi-digit luminescent display tubes when it is to be incorporated into an electronic device. Therefore, problems exist from the standpoint of operational efficiency or production.

Various multi-digit luminescent display tubes recently proposed in view of the above facts are of the type which has a container containing a plurality of pattern display sections arranged in the form of a matrix or in the directions of row and column so that the amount of information that can be displayed may be increased and diversified. The multi-digit luminescent display tube of this type will be hereinafter described with reference to FIG. 1 which shows a schematical plan view of the essential part thereof.

In FIG. 1, the reference numeral 1 designates a substrate made of insulating material such as glass or ceramics. A plurality of pattern display sections $2(2_{11}, \ldots, 2_{mn})$ are arranged on the substrate 1 in the form of a matrix or in the directions of row and column. Each of the pattern display sections 2 is made up of a plurality of segment anodes each having a luminescent material layer thereon. Control grids $3(3_{11}, \ldots, 3_{mn})$ are provided above and in the vicinity of the pattern display sections $2(2_{11}, \ldots, 2_{mn})$, respectively. Filament-shaped cathodes $4(4_1, \ldots, 4_{mn})$, which are adapted to emit thermions when heated, are stretched over the control grids 3 in the direction of, for instance, the row of the matrix of the pattern display sections 2. In addition, a box-shaped or flat-bottom-boat-shaped front bulb (though not shown) made of transparent material such as glass is bonded at its periphery to the substrate or base plate 1 so that the above-mentioned anodes, grids, cathodes and the like may be kept airtight in a vacuum.

Reference numeral 5 designates external terminals connected to the above anodes, grids, cathodes and the like so as to energize them.

In the multi-digit luminescent tube constructed as above, thermions emitted from the cathodes or filaments 4 impinge on the pattern display sections 2 to excite the luminescent material thereby making it luminesce, only when the pattern display sections 2 and grids 3 are both sufficiently positive with respect to the cathodes or filaments 4. In this tube, therefore, the pattern display sections 2 corresponding to necessary digits may be selectively excited to luminesce by selectively making the corresponding pattern display sections 2 and grids 3 positive with respect to the filaments 4.

In the case of the multi-digit luminescent tube of the type mentioned above, the following driving method has been proposed to selectively excite each pattern display section 2 to make it luminesce while making the number of the external terminals 5 as small as possible.

Corresponding segment anodes of the pattern display sections 2 of all digits are electrically connected to each other, respectively. Grids 3 of each column are electrically connected to each other, being connected to the corresponding external terminal 5. The filament 4 for each row is connected to the corresponding external terminal 5 independently.

With the above-mentioned arrangement, the display signal is given to the pattern display sections 2 in which the corresponding segment anodes are connected to each other throughout all the digits; the column-selecting signal is given in a time-sharing manner to the grids 3 which are connected to each other for each column; and power for heating is given to the filament 4 provided for each row, and in addition signals are given to the filament 4 to make the potential thereof substantially negative in response to the above display signal and column-selecting signal.

Under the above-mentioned conditions, if a negative potential given to the filament $4_1$ provided for the first row of the matrix of the pattern display sections 2 and the first-column grids $(3_{11}, 3_{21}, \ldots, 3_{m1})$ are selected in response to the column-selecting signal, the above-mentioned requirement for luminescing will be satisfied only at the pattern display section $2_{11}$ positioned at the intersection of the first row and first column of the matrix, and therefore luminescent display is performed at the pattern display section $2_{11}$. If, then, the column-selecting signal is shifted to the second-column grids $3(3_{12}, 3_{22}, \ldots, 3_{m2})$, the first-row second-column pattern display section $2_{12}$ will satisfy the luminescing requirements and therefore will perform luminescent display. After the luminescent display at the pattern display sections 2 on the first row is completed in this manner, the filament $4_2$ for the second-row pattern display sections $2(2_{21}, 2_{22}, \ldots, 2_{2n})$ are made negative and thereby selectively performs luminescent display. In the same manner, luminescent display can be performed up to the m-th row and n-th column pattern display section $2_{mn}$. In this case, it is not necessarily required to make the pattern display sections 2 luminesce in the order mentioned above and to make the pattern display sections 2 of all digits luminesce at one display operation. In short, the pattern display sections 2 positioned at the points where the column of the grids 3 to which the column-selecting signal is given intersect with the filament 4 to which a negative potential is given.

The above-mentioned driving method can minimize the number of the external terminals 5 that must be added when the number of the pattern display sections 2 and that of the anodes of the pattern display section are increased. In addition, it permits easy production, simple driving circuits and low cost.

However, the above driving method has the following disadvantage:

As mentioned above, the first-row first-column pattern display section $2_{11}$ is selected for luminescing, when the filament $4_1$ for the first-row pattern display sections 2 ($2_{11}$, $2_{12}$, . . . , $2_{1n}$) is at a negative potential and the first-column grids 3($3_{11}$, $3_{21}$, . . . , $3_{m1}$) are selected in response to the column-selecting signal. In this case, the second-row first-column grid $3_{21}$ is also kept at a positive potential under the influence of the column-selecting signal and the display signal is given to the pattern display sections throughout all the digits; therefore, thermions emitted from the filament $4_1$ tend to impinge on the unselected pattern display section $2_{21}$ under the influence of an electric field formed by the grid $3_{21}$ kept at a positive potential and thereby to excite it for luminescing. In short, there is a possibility that the above-driving method is accompanied by leakage luminescence occurring at the pattern display sections 2 on the unselected row.

BRIEF SUMMARY OF THE INVENTION

The present invention contemplates to eliminate the above-mentioned disadvantages of the prior art.

The primary object of the present invention is to provide a multi-digit luminescent display tube which can eliminate leakage luminescence.

Another object of the present invention is to provide a multi-digit luminescent display tube which can give very clear and correct display.

According to the present invention, there is provided a multi-digit luminescent display tube having a plurality of pattern display sections arranged in the form of a matrix composed of a plurality of rows and columns and adapted to luminescently display a plurality of patterns such as characters and numerals, the pattern display sections being contained in a vacuum container, each of the pattern display sections being composed of a plurality of anodes each having a luminescent material layer thereon, those of the anodes which form the corresponding parts of the pattern display sections being electrically connected in common to each other, a plurality of control grids provided above the pattern display sections respectively so as to accelerate and control thermions moving toward the pattern display sections, the control grids on each column or row being electrically connected to each other, a plurality of cathode filaments provided above and opposite to the pattern display sections and control grids in the direction of row or column vertical to the direction along which the control grids are electrically connected to each other, and a plurality of shielding members provided midway between the rows or columns of the matrix in the direction along which the cathode filaments are arranged, the shielding members shielding the pattern display sections from thermions emitted from the filaments not corresponding thereto.

DETAILED DESCRIPTION OF THE PREFERRED EMBODIMENTS

Now the present invention will be hereinafter described in detail with reference to the accompanying drawings.

Figure 1:
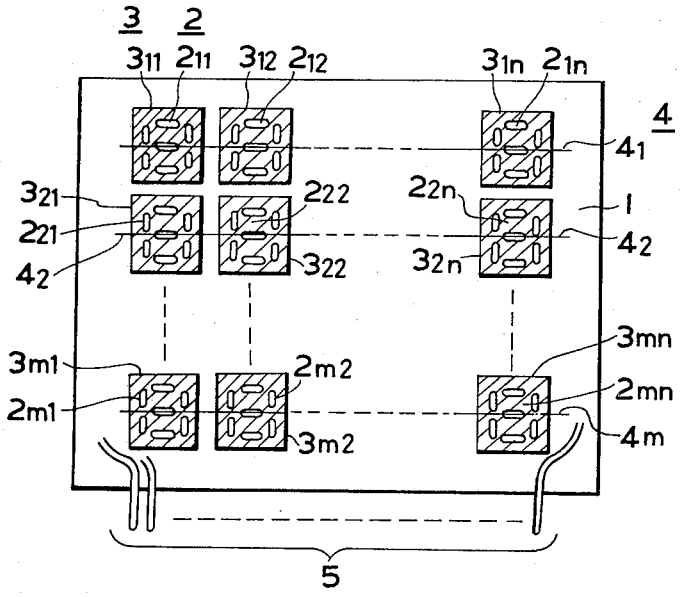
FIG. 1 (PRIOR ART)
FIG. 1 is a schematic plan view of the essential part of the multi-digit luminescent display tube having a plurality of pattern display sections arranged in the form of a matrix according to an example of the prior art.
Figure 2:
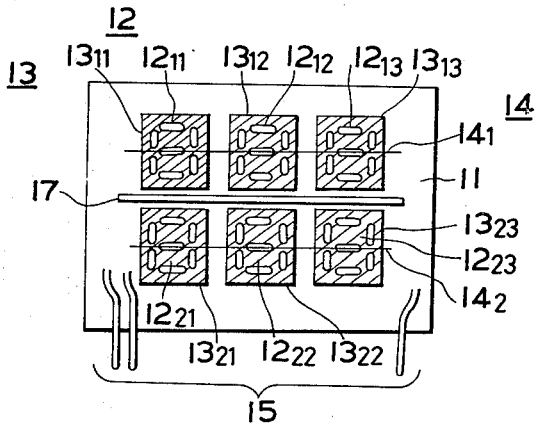
FIG. 2 is a schematic plan view of the essential part of the multi-digit luminescent display tube according to one embodiment of the present invention.
Figure 5:
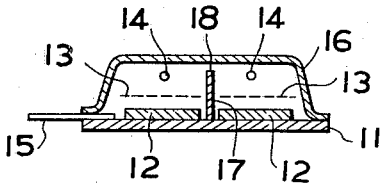
FIG. 5 is a sectional view of the tube shown in FIG. 2.

First, reference is made to FIGS. 2 and 5 which show one embodiment of the present invention.

Reference numeral 11 designates a substrate or base plate made of insulating material such as glass or ceramics. A plurality of pattern display sections 12($12_{11}$, . . . , $12_{23}$) each composed of a plurality of segment-shaped or dot-shaped anodes each having a luminescent material layer thereon are formed on the base plate 11. The pattern display sections 12 are arranged in the form of a matrix. In FIG. 2, the matrix is shown as formed of two rows and three columns, for the sake of simplicity in description.

Reference numeral 13($13_{11}$, . . . , $13_{23}$) designates control grids provided above and in the vicinity of the pattern display sections 12. The control grids 13 are electrically connected in common to each other by the column of the matrix. Reference numeral 14($14_1$ and $14_2$) designates cathode filaments provided above the grids 13 and electrically connected in common to each other by the row of the matrix. Numeral 15 designates external terminals connected to the above-mentioned anodes, grids and cathode filaments. Numeral 16 designates a front bulb of, for instance, flat-bottom-boat-shaped glass. The front bulb, through which the external terminals 15 are airtightly penetrated, is bonded to the base plate 11 at the open end thereof to form the casing of the multi-digit luminescent display tube. The inside of the casing, in which the above anodes, grids, cathode filaments, etc. are contained, is airtightly kept at a vacuum.

Reference numeral 17 is a shielding member positioned opposite to the inside surface of the front bulb 16 with a gap 18 therebetween and provided midway between the rows of the matrix of the pattern display sections 12. The shielding member 17 is made of insulating material such as glass.

Figure 3:
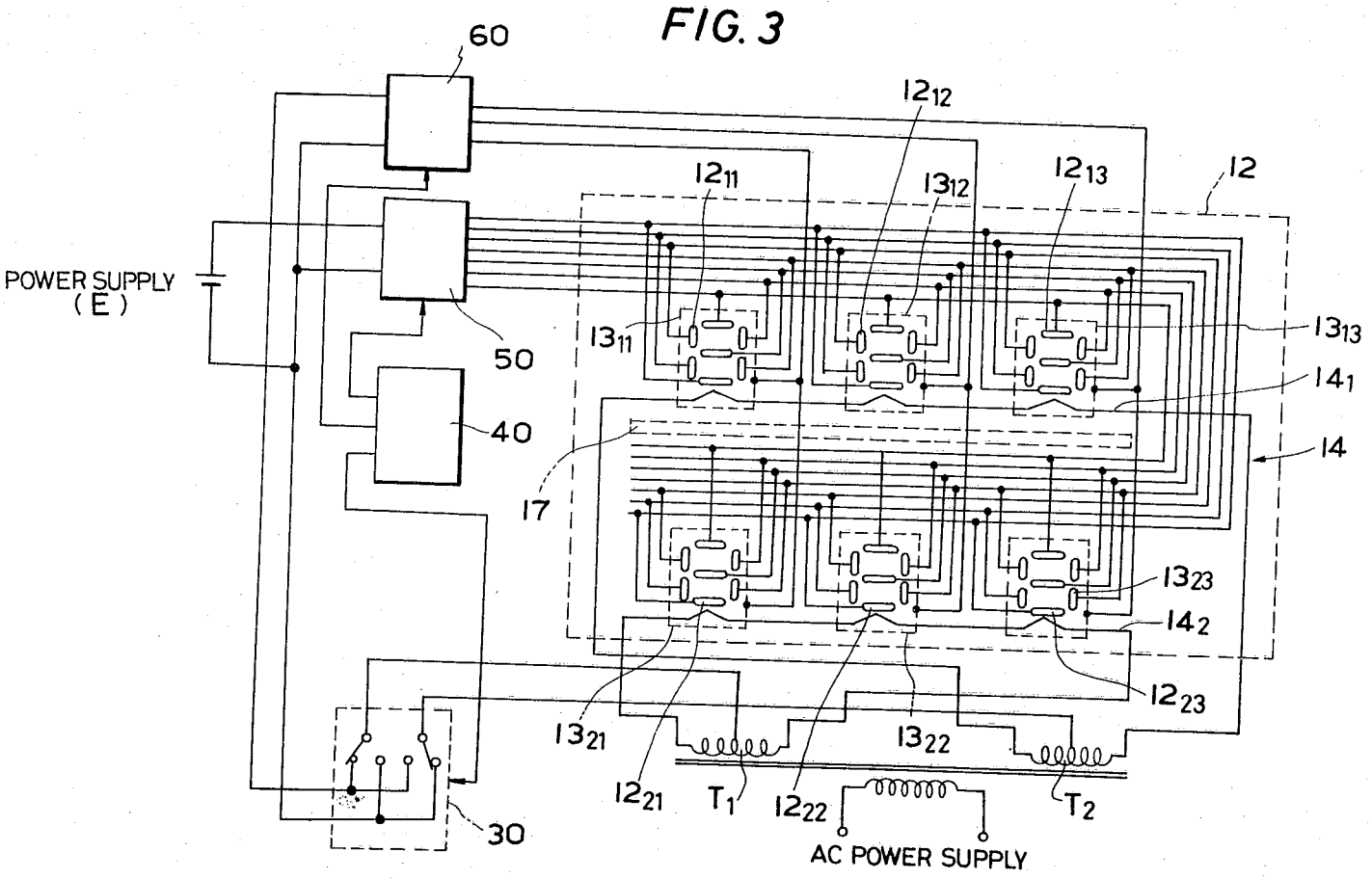
FIG. 3 is a circuit diagram for driving the multi-digit luminescent display tube shown in FIG. 2.

As shown in FIG. 3, the corresponding anodes of the pattern display sections 12 are connected in common to each other throughout all the digits, being given the display signal. The grids 13 are given the column-selecting signal at a predetermined timing to select each column of the matrix of the pattern display sections 12. The filament 14 positioned along each row is independently connected to each of power supplies $T_1$ and $T_2$ for heating. The electric potential of the power supply is controlled so as to be either in a positive or negative potential with respect to the potential of a power supply E for an anode driving circuit 50 and a grid driving circuit 60 by means of a filament control circuit 30.

When the electric potential of the power supply for heating the filament is controlled in a positive with respect to the electric potential of the power supply E, the filament is electrically charged with the same electric potential as that of the grids, and the pattern display section in the row on which the positively charged filament is stretched is inactivated to luminesce, because thermions emitted from the filament will not be accelerated by the grids so as to reach the anodes of the pattern display section.

To the contrary, when the electric potential of the power supply for heating the filament is controlled in a negative with respect to the electric potential of the power supply E, thermions emitted from the filament will be accelerated by the grids to impinge on the pattern display section thereby making the pattern display section luminesce.

In other words, if each of the filaments 14($14_1$ and $14_2$) is heated by the power supplies for heating $T_1$ and $T_2$, respectively, if a negative potential is given to the first-row filament $14_1$ while maintaining the second-row filament $14_2$ a positive potential and if the display signal is given to the pattern display sections 12 while the column-selecting signal is given to the first-column grids 13($13_{11}$ and $13_{12}$), thermions emitted from the filament $14_1$ will be accelerated by the action of the grid $13_{11}$ to impinge on the pattern display section $12_{11}$ thereby exciting the luminescent material and making the pattern $12_{11}$ luminesce.

The timing for making the power supply for heating biased either in a negative or positive is determined by a timing control circuit 40. The timing control circuit 40 sends signals to the filament control circuit 30 so that the electric potential of the power supply for the filament of each row may be biased either in a negative or positive potential every one cyclic scanning of the grids. In FIG. 3, the filament control circuit 30 is shown as a fundamental switching circuit, however, as a matter of fact, it is composed of a logic circuit which is controlled by the timing control circuit.

Figure 4:
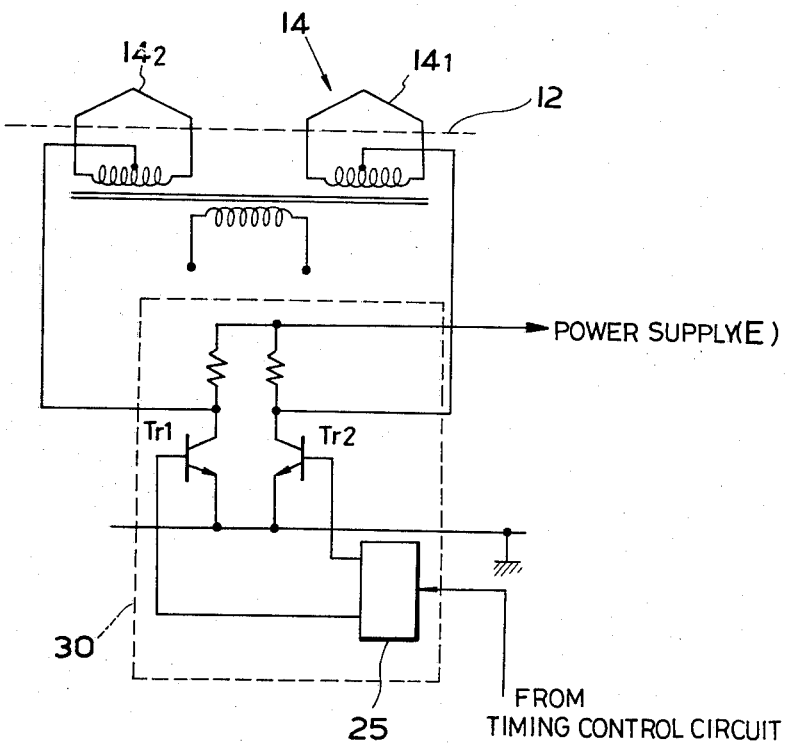
FIG. 4 is a circuit diagram of a filament control circuit according to the other embodiment of the present invention which is used in the driving circuit for the multi-digit luminescent display tube shown in FIG. 2.

The filament control circuit actually used in an embodiment of the present invention is shown in FIG. 4. The display tube shown in FIG. 4 includes two independent filaments $14_1$ and $14_2$, the electric potential of which is alternately switched either in a negative or positive potential with the use of two transistors $Tr_1$ and $Tr_2$ which are alternately switched "on" or "off" by outputs from a gate circuit 25. The gate circuit 25 may be made of a flip-flop which inverts outputs by responding to timing signals from the timing control circuit. In the display tube having the independent filament of more than three, counters corresponding to the number of the independent filaments may be used.

In the embodiment shown in FIGS. 2 and 3, the grid $13_{21}$ is also kept at a positive potential, since it is also given the column-selecting signals; and, in addition, the pattern display section $12_{21}$ is also given the display signal. Therefore, thermions emitted from the filament $14_1$ tend to impinge on the pattern display section $12_{21}$ under the influence of a positive electric field formed by the grid $13_{21}$ and the filament $14_2$. In other words, thermions emitted from the selected filament 14 tend to impinge on the unselected pattern display sections 12.

However, the shielding member 17 provided midway between the filament $14_1$ and the pattern display section $12_{21}$ can prevent the above unfavorable tendency, because thermions moving from the filament $14_1$ to the pattern display section $12_{21}$ electrify the shielding member 17 thereby keeping it at a negative potential. For this reason, the shielding member 17 kept at the negative potential makes a negative electric field and thereby the pattern display section $12_{21}$ is shielded from the filament $14_1$. Thus, thermions emitted from the filament $14_1$ are prevented from impinging on the pattern display section $12_{21}$. As a result, leakage luminescence caused by the mutual influence of adjacent rows is completely prevented.

As mentioned above, the shielding member 17 provided midway between the rows of the pattern display sections 12 and the electric field formed by the negatively charged shielding member 17 can give electrostatic shielding to the space between the rows of the pattern display sections 12. Thus, only the selected pattern display sections 12 can be securely displayed luminescently; therefore the present invention can achieve clear display of correct information.

In the above preferred embodiment of the present invention, the gap 18 is provided between the top end of the shielding member 17 and the inside surface of the front bulb 16. The gap 18 is provided to prevent the possibility that the shielding member 17 may reduce the visibility of the pattern display sections 12 arranged in the row direction. Accordingly, if the direction of viewing the pattern display sections 12 is considered substantially constant and therefore it is not necessary to take the visibility into consideration, it will be not required to provide the gap 18.

Figure 6:
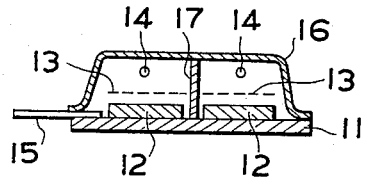
FIGS. 6 to 8 are schematic sectional views of the essential parts of the multi-digit luminescent display tubes according to other embodiments of the present invention, respectively.

For the above reason, the top end of the shielding member 17 may be in contact with the inside surface of the front bulb 16 as shown in FIG. 6. In this case, the shielding member 17 performs the reinforcing function for the front bulb 16 in addition to the above-mentioned shielding function. This embodiment is very effective for producing large-sized display tubes.

The front bulb 16, which forms a part of the casing, is generally provided on its inside surface with a transparent conductive layer. The transparent conductive layer is given the same negative potential as the cathode filament so as to prevent the influence of an external electrostatic field on the pattern display sections, such as display defects.

Figure 7:
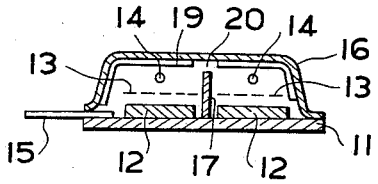

In the case of a display tube in which the front bulb 16 is provided on its inside surface with a transparent layer 19 as shown in FIG. 7, the following method may be used to more fully prevent thermions from entering the space between the rows of the matrix of the pattern display sections 12:

The transparent conductive layer 19 is removed at the portion opposite to the top end of the shielding member 17 to form a boundary portion 20. The boundary portion 20 may be formed by peeling off the transparent conductive layer 19 or by preventing formation of the layer 19 using a mask when the layer 19 is deposited. The boundary portion 20 thus provided on the inside surface of the front bulb 16 is electrified by thermions emitted from the filament 14. The negative electric field created by thermions or electrons deposited on the boundary portion 20 and that created by thermions or electrons charged on the shielding member 17 cooperate to fully prevent entry of thermions emitted, for instance, from the first-row filament $14_1$ into the space near the second-row pattern display sections 12($12_{21}$, $12_{22}$, $12_{23}$).

Figure 8:
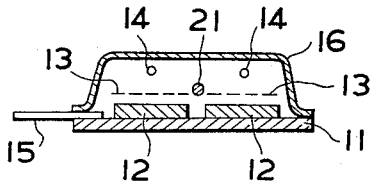
Figure 3:
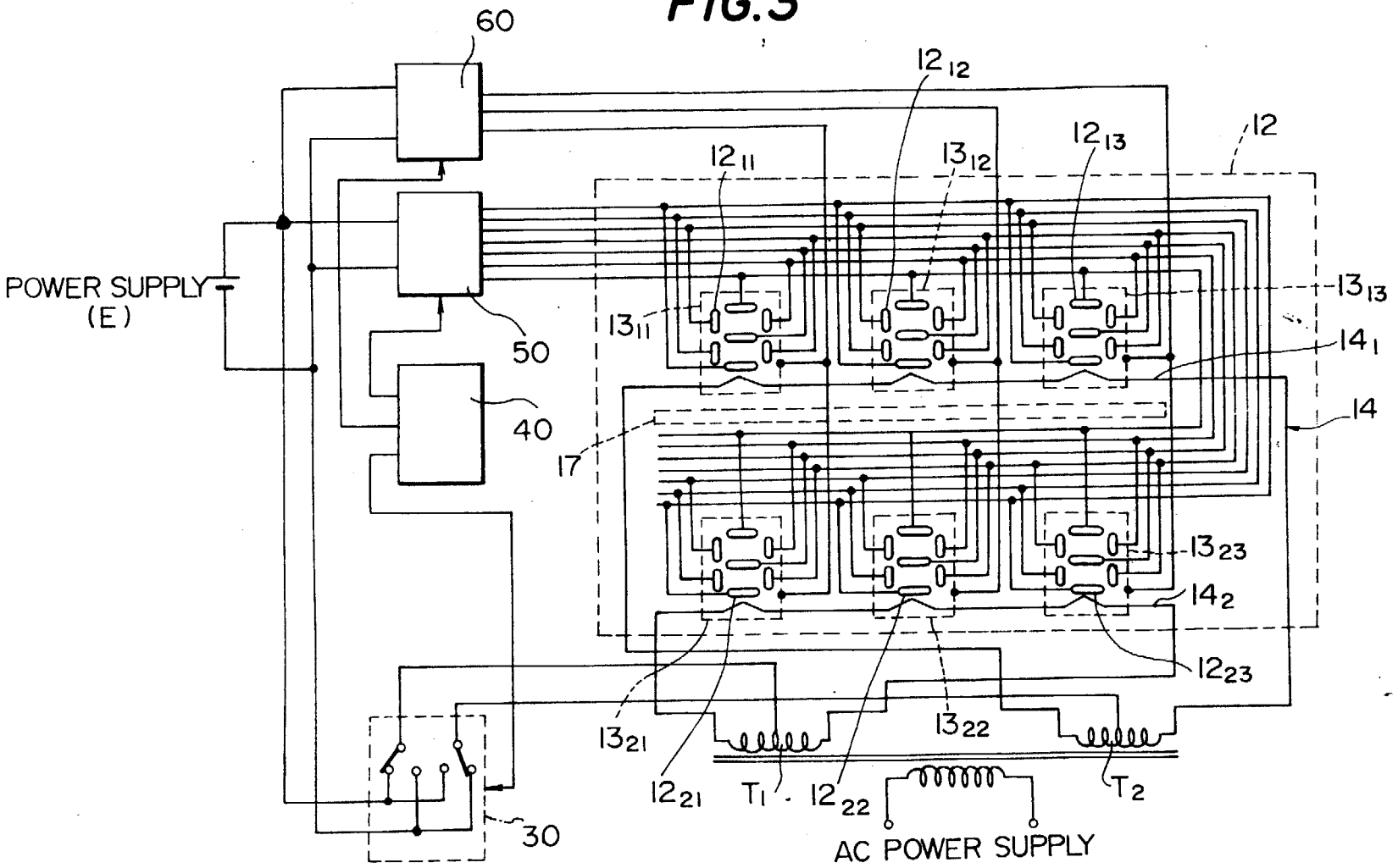

In the above-mentioned preferred embodiments, the shielding member 17 is shown as formed of insulating material, but may be made of conductive material in the following manner:

As shown in FIG. 8, a conductive metal wire 21 is provided midway between the rows of the matrix of the pattern display sections 12 parallel therewith. The metal wire 21 is at all times kept at a considerably negative potential equivalent to or nearly equivalent to the negative potential selectively given to the filaments 14. Thus, the electric field formed by the negative potential of the metal wire 21 can prevent thermions from impinging on the unselected pattern display sections 12. Instead of the above-mentioned metal wire 21, a conductive thin strip or mesh-shaped piece to which a negative potential is given may be used as a matter of course.

In the above preferred embodiments, the control grids 3 on each column are electrically connected in common to each other and the filaments 4 are provided along the rows of the matrix and electrically independently of each other. However, the control grids 3 on each row may be electrically connected in common to each other, and the filaments 4 may be provided along the columns of the matrix and electrically independently of each other.

As is apparent from the foregoing description, the multi-digit luminescent display tube according to the present invention has the following features and effects.

A shielding member or members are provided midway between the adjacent rows of the pattern display sections arranged in the form of a matrix. Therefore, when the grids on each column are electrically connected in common to each other and are given the column-selecting signal while the filaments provided in the direction of row are heated independently of each other and are selectively given a negative potential and thereby the pattern display sections are selectively excited for luminescing, the occurrence of leakage luminescence due to the mutual interaction between adjacent rows is completely prevented and therefore correct and clear luminescent display can be obtained.

The pattern display sections are arranged in the directions of row and column in the form of a matrix. Each pattern display section is composed of segment anodes. The corresponding anodes of the pattern display sections are electrically connected in common to each other. The grids on each column are electrically connected in common to each other. The filament on each row is given the potential independently. These anodes, filaments and grids are connected to the external terminals, respectively. In addition, the shielding members are provided midway between adjacent rows as mentioned above. With the above construction, a great number of pattern display sections arranged in the form of a matrix composed of a plurality of rows and columns and capable of high-quality display with no leakage luminescence can be formed by the use of a very small amount of wiring and a very small number of external terminals; therefore, the tube according to the present invention is very easy to produce and can be advantageously made small in size. In addition, in the external electronic device into which the tube of the present invention is incorporated, its circuits and the like can be made small in size and simple. Thus the tube according to the present invention can bring about mass production, cost reduction, increase of the number of applications, etc., of not only itself but also any related electronic device.

Obviously many modifications and variations of the present invention are possible in the light of the above teachings. It is therefore to be understood that within the appended claims the invention may be practiced otherwise than as specifically described.

What is claimed as new and desired to be secured by a Letters Patent of the United States is:

1. A multi-digit luminescent display tube comprising:

a vacuum container;

a plurality of pattern display sections arranged in the form of a matrix composed of a plurality of rows and columns and adapted to luminescently display a plurality of patterns such as characters and numerals, said pattern display sections being contained in said vacuum container, each of said pattern display sections being composed of a plurality of anodes each having a luminescent material layer thereon, those of said anodes which form the corresponding parts of the pattern display sections being electrically connected in common to each other;

a plurality of control grids provided above said pattern display sections respectively so as to accelerate and control thermions moving toward said pattern display sections, said control grids on each column or row being electrically connected in common to each other;

a plurality of cathode filaments for emitting thermions when heated provided above and opposite to said pattern display sections and control grids in the direction of row or column vertical to the direction along which said control grids are electrically connected in common to each other, said cathode filaments being independently connected to respective power supplies for heating;

a filament control circuit for switching electric potential of each of said power supplies either to a positive or negative potential with respect to electric potential of a power supply for driving said pattern display sections and control grids synchronously with the scanning of the control grids; and a plurality of shield means provided midway between the rows or columns of the matrix of said pattern display sections in the direction along which said cathode filaments are arranged for preventing thermions emitted from said cathode filaments from being accelerated by the action of control grids not below and opposite thereto, whereby thermions emitted from a selected cathode filament impinge only on a pattern display section corresponding thereto.

2. The multi-digit luminescent display tube as set forth in claim 1, wherein said control circuit is a switching circuit controlled by signals from a timing control circuit.

3. The multi-digit luminescent display tube as set forth in claim 2, wherein said filament control circuit is a logic circuit.

4. The multi-digit luminescent display tube as set forth in claim 1, wherein said shield means are made of insulating material.

5. The multi-digit luminescent display tube as set forth in claim 1, wherein said shield means are made of conductive material to which a shielding potential can be given.

* * * * *

UNITED STATES PATENT AND TRADEMARK OFFICE

CERTIFICATE OF CORRECTION

PATENT NO. : 4,232,251

DATED : November 4, 1980

INVENTOR(S) : Takao Kishino et al.

It is certified that error appears in the above—identified patent and that said Letters Patent is hereby corrected as shown below:

FIGURE 3, should appear as shown on the attached sheet.

Signed and Sealed this

*Seventh* Day of *July 1981*

[SEAL]

*Attest:*

RENE D. TEGTMEYER

*Attesting Officer* *Acting Commissioner of Patents and Trademarks*

Takao Kishino et al.